US008803774B2

(12) United States Patent
Hiraki et al.

(10) Patent No.: US 8,803,774 B2
(45) Date of Patent: Aug. 12, 2014

(54) LIQUID CRYSTAL DISPLAY AND PROCESSING METHOD THEREOF

(75) Inventors: Katsuyoshi Hiraki, Kawasaki (JP); Toshiaki Suzuki, Kawasaki (JP)

(73) Assignee: AU Optronics Corporation, Hsin-Chu (TW)

( * ) Notice: Subject to any disclaimer, the term of this patent is extended or adjusted under 35 U.S.C. 154(b) by 2311 days.

(21) Appl. No.: 10/976,955

(22) Filed: Oct. 29, 2004

(65) Prior Publication Data

US 2005/0243075 A1 Nov. 3, 2005

(30) Foreign Application Priority Data

Apr. 28, 2004 (JP) ..... 2004-134204

(51) Int. Cl.
*G09G 3/36* (2006.01)
*G09G 5/10* (2006.01)

(52) U.S. Cl.
CPC ..... *G09G 3/3648* (2013.01); *G09G 2360/18* (2013.01); *G09G 2310/04* (2013.01); *G09G 2340/0407* (2013.01); *G09G 2320/103* (2013.01); *G09G 2320/0285* (2013.01); *G09G 2310/027* (2013.01); *G09G 2320/0233* (2013.01)
USPC ..... 345/87; 345/690

(58) Field of Classification Search
USPC ..... 345/87, 90, 94, 98, 99, 100, 101, 698, 345/699; 349/33
See application file for complete search history.

(56) References Cited

U.S. PATENT DOCUMENTS

| | | | | |
|---|---|---|---|---|
| 5,920,300 | A * | 7/1999 | Yamazaki et al. | 345/94 |
| 5,963,193 | A * | 10/1999 | Knox et al. | 345/601 |
| 6,091,389 | A * | 7/2000 | Maeda et al. | 345/98 |
| 6,219,017 | B1 * | 4/2001 | Shimada et al. | 345/88 |
| 6,373,497 | B1 * | 4/2002 | McKnight et al. | 345/602 |
| 6,501,451 | B1 * | 12/2002 | Sakashita | 345/87 |
| 6,556,180 | B1 * | 4/2003 | Furuhashi et al. | 345/87 |
| 6,791,525 | B2 * | 9/2004 | Matsumura et al. | 345/100 |
| 6,833,886 | B2 * | 12/2004 | Suzuki et al. | 349/87 |
| 6,853,384 | B2 * | 2/2005 | Miyata et al. | 345/601 |
| 6,894,669 | B2 * | 5/2005 | Suzuki et al. | 345/87 |
| 6,977,636 | B2 * | 12/2005 | Jinda et al. | 345/94 |
| 7,023,414 | B2 | 4/2006 | Ham | |

(Continued)

FOREIGN PATENT DOCUMENTS

| | | |
|---|---|---|
| CN | 1407535 | 4/2002 |
| JP | 2003-36055 | 2/2003 |

(Continued)

OTHER PUBLICATIONS

Japanese Office Action dated Mar. 23, 2010, with partial English translation.

*Primary Examiner* — Michael Faragalla
(74) *Attorney, Agent, or Firm* — CKC & Partners Co., Ltd.

(57) ABSTRACT

A liquid crystal display is provided, including a conversion circuit to convert a first image data to a second image data, a frame memory to store the second image data, a difference circuit to output in units of pixel a difference data between the second image data of the present frame to be converted and a third image data of an antecedent frame to be outputted from the frame memory, a correction circuit to correct the difference data based on one of the first to third image data, and an adding circuit to add the corrected difference data and the first image data.

18 Claims, 8 Drawing Sheets

(56) References Cited

U.S. PATENT DOCUMENTS

| | | | | |
|---|---|---|---|---|
| 7,154,467 | B2 * | 12/2006 | Kojima et al. | 345/100 |
| 7,202,882 | B2 | 4/2007 | Morita | |
| 2002/0033789 | A1 | 3/2002 | Miyata et al. | |
| 2002/0033813 | A1 | 3/2002 | Matsumura et al. | |
| 2002/0140652 | A1 | 10/2002 | Suzuki et al. | |
| 2003/0128176 | A1 * | 7/2003 | Ham | 345/87 |
| 2004/0217930 | A1 * | 11/2004 | Someya et al. | 345/87 |

FOREIGN PATENT DOCUMENTS

| | | |
|---|---|---|
| JP | 2003-84736 | 3/2003 |
| JP | 2003-143556 | 5/2003 |
| KR | 2002-0028781 | 4/2002 |

* cited by examiner

LIQUID CRYSTAL DISPLAY AND PROCESSING METHOD THEREOF

CROSS-REFERENCE TO RELATED APPLICATIONS

This application is based upon and claims the benefit of priority from the prior Japanese Patent Application No. 2004-134204, filed on Apr. 28, 2004, the entire contents of which are incorporated herein by reference.

BACKGROUND OF THE INVENTION

1. Field of the Invention

This invention relates to a liquid crystal display, and more particularly, to correction of an image data.

2. Description of the Related Art

In recent years, with demands for energy saving and space saving, notebook PCs (personal computers) or desktop PCs carrying a liquid display monitor are spreading their market. In such a trend, even higher-speed responses are demanded for a liquid crystal display so as to improve the characteristics for displaying moving images and so forth. Accordingly, the improvement of the response of the liquid crystal display is intended through the material characteristics of crystal display, display element structure, and development of a driving method.

In Patent Document 1 described below, a liquid crystal display is disclosed which, in correcting an image date signal and generating a correction date signal, generates a present correction data by a present image date signal and an antecedent correction data signal.

Also in Patent Document 2 described below, a liquid crystal display is disclosed which carries a conversion table to refer to a display-driven data of a present frame through an image data of the present frame and a post-driven-state data of an antecedent frame.

[Patent Document 1] U.S. Patent Application Publication No. U.S. 2002/033813 (Japanese Patent Application Laid-open No. 2002-99249)

[Patent Document 2] U.S. Patent Application Publication No. U.S. 2002/0140652 (Japanese Patent Application Laid-open No. 2002-297104)

SUMMARY OF THE INVENTION

It is an object of the present invention to provide a liquid crystal display which performs high-speed-response driving, has small amounts of memory, and allows the high-definition image display, as well as to provide a processing method thereof.

According to one aspect of the present invention, a liquid crystal display is provided which includes: a conversion circuit to convert a first image data to a second image data having a fewer number of bits; a frame memory to store the second image data; a difference circuit to output, in units of pixel, a difference data between the second image data of the present frame to be converted and a third image data of an antecedent frame to be outputted from the frame memory; a correction circuit to correct the difference data according to one of the first to third image data; and an adding circuit to add the corrected difference data and the first image data.

DETAILED DESCRIPTION OF THE PREFERRED EMBODIMENTS

Figure 1:
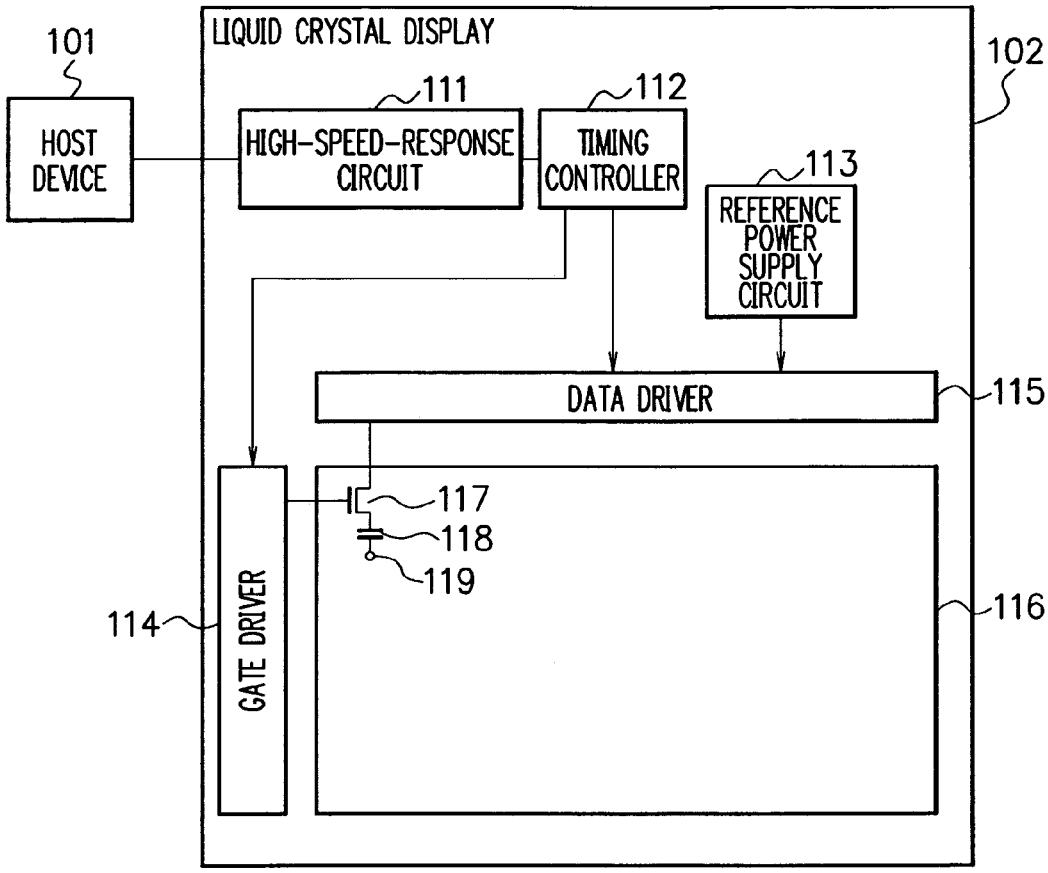
FIG. 1 is a block diagram showing an example of a structure of a host device and a liquid crystal display according to an embodiment of the present invention.

FIG. 1 is a block diagram showing an example of a structure of a host device 101 and a liquid crystal display 102, according to a preferred embodiment of the present invention. The host device 101 is, for example, a personal computer, TV receiver or the like, which outputs image data to the liquid crystal display 102. The liquid crystal display includes a high-speed-response circuit 111, a timing controller 112, a reference power supply circuit 113, a gate driver 114, a data driver 115, and a liquid crystal panel 116.

The high-speed-response circuit 111 inputs therein an image data from the host device 101, and corrects the image data for the high-response driving of the liquid crystal panel 116. The timing controller 112 inputs therein the corrected image data, and controls the timing of the gate driver 114 and data driver 115. The corrected image data is supplied to the data driver 115 through the timing controller 112. The image data includes, for example, red, green, and blue image data having 8 bits respectively. The data driver 115 supplies the liquid crystal driving voltage to the liquid crystal panel 116 according to the image data (tone value). The reference power supply circuit 113 generates plural reference power supply voltages corresponding to the tone values of the image data in predetermined intervals, and outputs to the data driver 115. According to the plural reference power supply voltages, the data driver 115 generates the liquid crystal driving voltages for all the tone values, selects the liquid crystal driving voltage for each image data, and outputs them to the liquid crystal panel 116.

The liquid crystal panel 116 includes plural thin-film transistors (TFT) 117 corresponding to the plural pixels arranged two-dimensionally. The transistor 117 has its gate connected to the gate driver 114, its drain connected to the data driver 115, and its source connected through a liquid crystal (capacitor) 118 to a common electrode 119.

The gate driver 114 outputs a gate pulse for sequentially selecting the transistors 117 arranged two-dimensionally to the gate of the transistor 117. Upon reception of the gate pulse, the transistor 117 is turned on and the liquid crystal driving voltage is provided to the liquid crystal 118 through the drain. According to the liquid crystal driving voltage, the transmittance of the liquid crystal 118 changes, and thereby the level of brightness changes.

Figure 6:
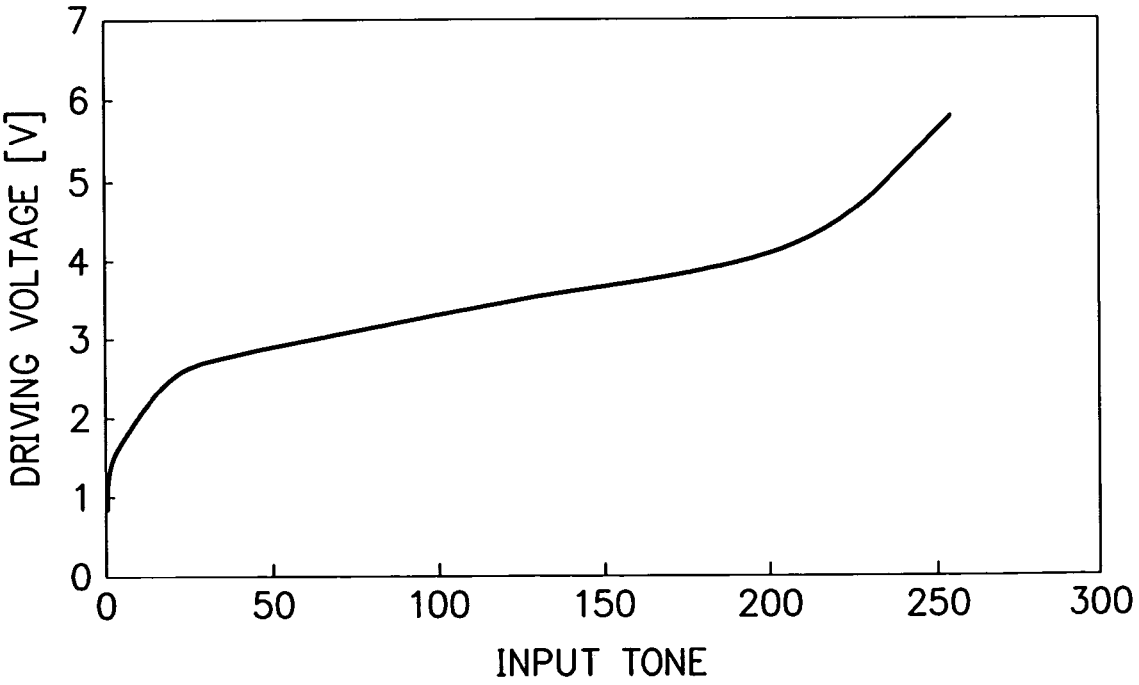
FIG. 6 is a graph showing an example of a relationship between tone value and liquid crystal driving voltage.

FIG. 6 is a graph showing an example of relationship between the tone value of an inputted data and the liquid crystal driving voltage. In accordance with the relationship, the data driver 115 performs conversion from an image data to a liquid crystal driving voltage. The inputted image data is for example 8 bits, and has tone values of 0 (zero) to 255.

Figure 3:
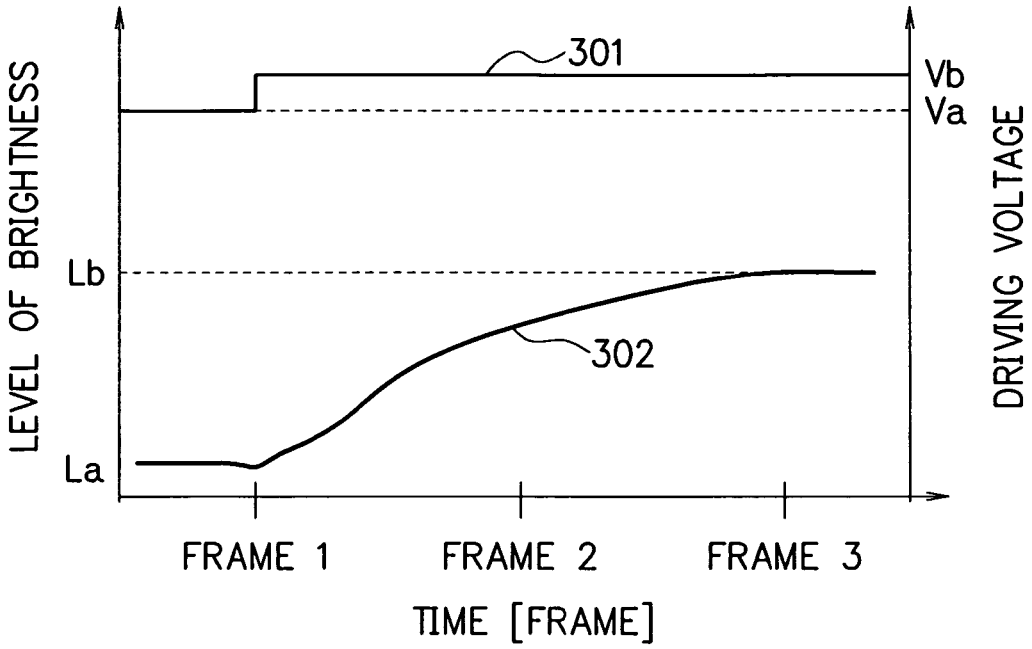
FIG. 3 is a diagram showing a relationship between time (frame) and liquid crystal driving voltage, and a relationship between time (frame) and level of brightness.
Figure 4:
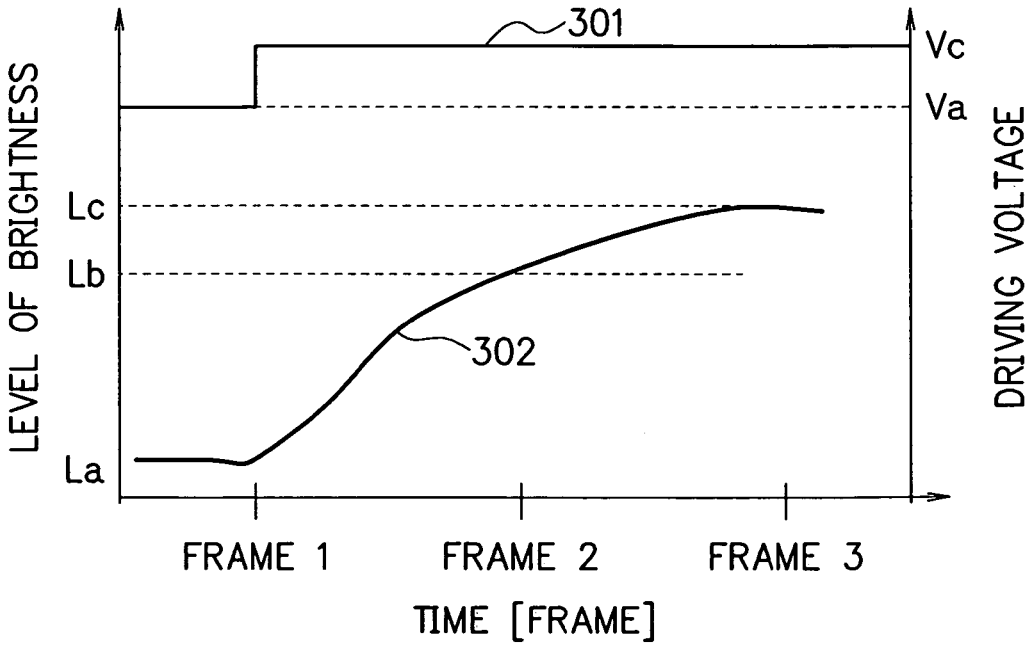
FIG. 4 is a diagram showing a relationship between time (frame) and liquid crystal driving voltage, and a relationship between time (frame) and level of brightness.
Figure 5:
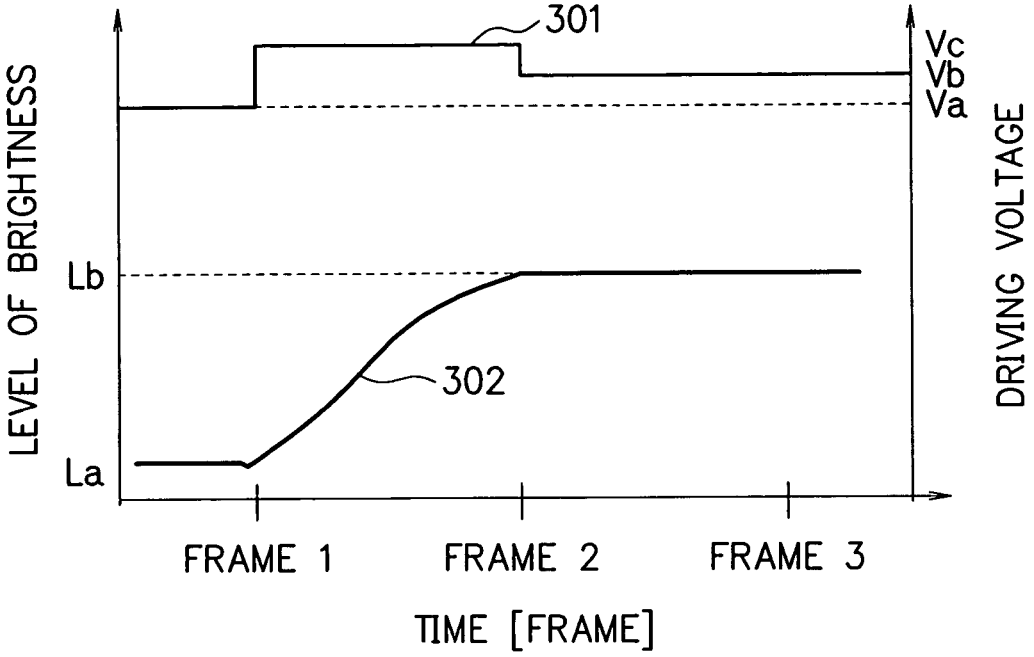
FIG. 5 is a diagram showing a relationship between time (frame) and liquid crystal driving voltage and a relationship between time (frame) and level of brightness.

FIGS. 3 to 5 illustrates a characteristic 301 showing a relationship between time (frame) and liquid crystal voltage, and a characteristic 302 between time (frame) and level of brightness.

In FIG. 3, when the image data transforms from Da to Db in the first frame, the liquid crystal driving voltage changes from Va to Vb. At that time, the level of brightness changes from La to Lb, but since the response by the liquid crystal is slow, reaching the targeted brightness Lb costs a few frames. For example, the level of brightness reaches Lb at the start point of the third frame.

On the other hand, as shown in FIG. 4, when the voltage which changes from the Va to Vc within the first frame is impressed to the liquid crystal panel, the brightness reaches Lb in the second frame, and Lc in the third frame. Here, the voltage Vc is a liquid crystal driving voltage for the image data Dc, and is higher than the voltage Vb.

As shown in FIG. 5, in the case of the inputted image data transforming from Da to Db, the image data is corrected such that it transforms in an order of Da, Dc, and Db. At the start point of the first frame, the voltage is changed from Va to Vc, and at the start point of the second frame, the voltage is changed from Vc to Vb. As a result, the level of brightness at the start point of the first frame becomes La, while the level of brightness at and after the start point of the second frame becomes Lb. This allows the liquid crystal to respond at a high speed.

Figure 2:
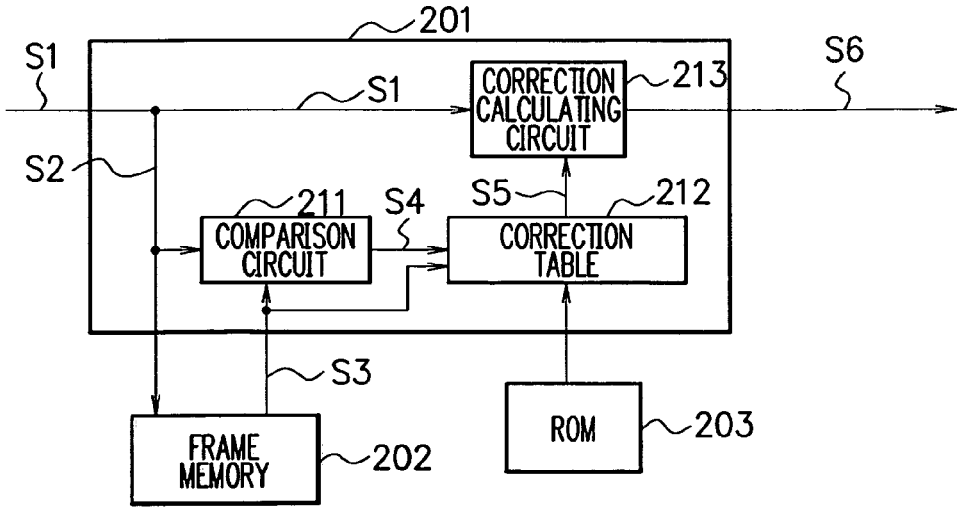
FIG. 2 is a block diagram showing an example of a structure of a high-speed-response circuit.

FIG. 2 is a block diagram showing an example of a structure of the high-speed-response circuit 111 (FIG. 1) which enables the operation shown in FIG. 5. The high-speed-response circuit 111 contains a processing circuit 201, a frame memory (SDRAM) 202 and a ROM 203. An image data S1 is inputted such that red, green, and blue image data respectively having m bits are inputted to the high-speed-response circuit 111 in a parallel manner. An image data S2 is an image data consisting of the upper u bits (n<m) in the image data S1 having m bits. The relationship between the image data S1 and S2 will be explained hereinafter, with reference to FIG. 10.

Figure 10:
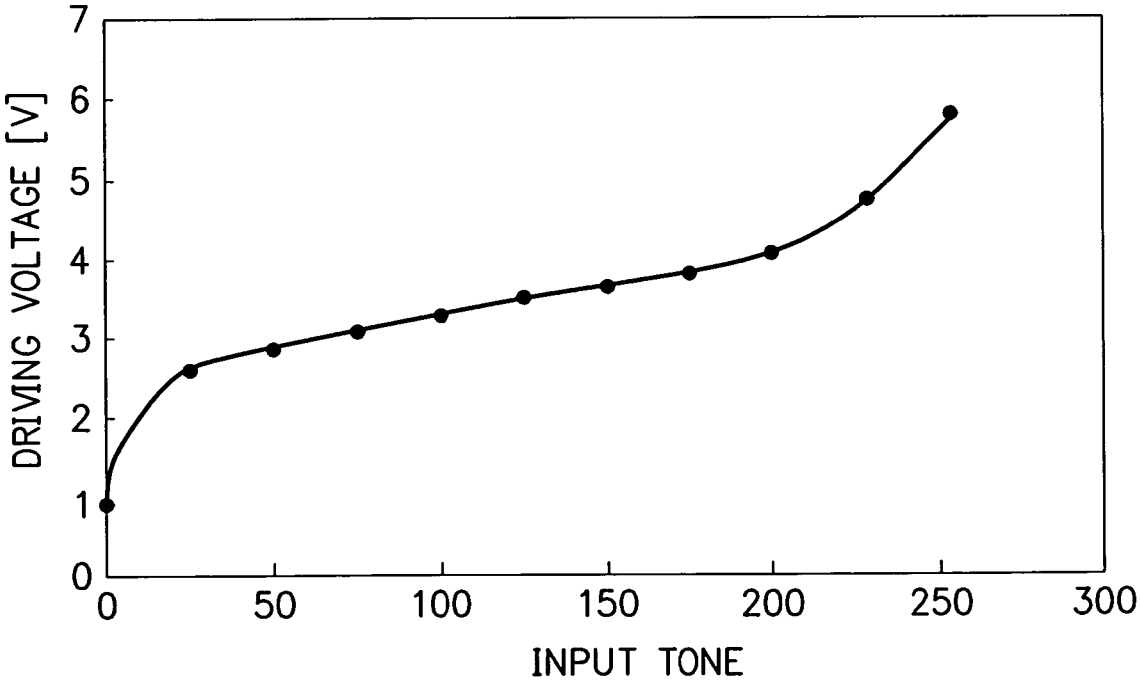
FIG. 10 is a graph showing an example of a relationship between tone value of an inputted data and liquid crystal driving voltage.

FIG. 10 is a graph showing an example of the relationship between the tone value of the inputted image data and the liquid crystal driving voltage. The solid line represents the image data S1 having m bits. the dots on the solid line represent the image data S2 having n bits. The image data S2 is mapped to the image data S1 in regular intervals and quantized.

In FIG. 2, the image data S2 is written in the frame memory 202. The frame memory 202 stores the image data S2 amounting to one frame. Since the image data S2 has fewer bits than the image data S1, the amount of the frame memory 202 can be reduced.

The frame memory 202 delays the image data S2 for one frame, and outputs the image data S3. The comparison circuit 211 compares the image data S2 of the present frame and the image data S3 of the antecedent frame, and outputs a difference data S4. For example, in FIG. 5, the present frame data S2 of the first frame is Db, while the antecedent frame data S3 is Da. The difference data S4 is Db−(minus) Da.

The correction table 212 corrects the difference data S4 according to the image data S3, and outputs a difference data S5. For example, as shown in FIG. 5, at the start point of the first frame, the image data is transformed from Da to Dc, and at the start point of the second frame, the image data is transformed from Dc to Db. Hence, when "Db−(minus) Da" is inputted as a difference data S4, "Dc−(minus) Db" is outputted as the difference data S5. In the following frame, 0 (zero) is outputted as the difference data S5. The correction table 212 reads therein the correction data from the ROM 203 in advance.

The correction calculating circuit 213 is an adding circuit, wherein the image data S1 and the difference data S5 are added and the image data S6 is outputted. For example, as shown in FIG. 5, the image data S1 is Db, the difference data S5 is Dc−(minus) Db, and the image data S6 is Dc. Thus, the high-speed response driving shown in FIG. 5 can be realized.

Figure 7:
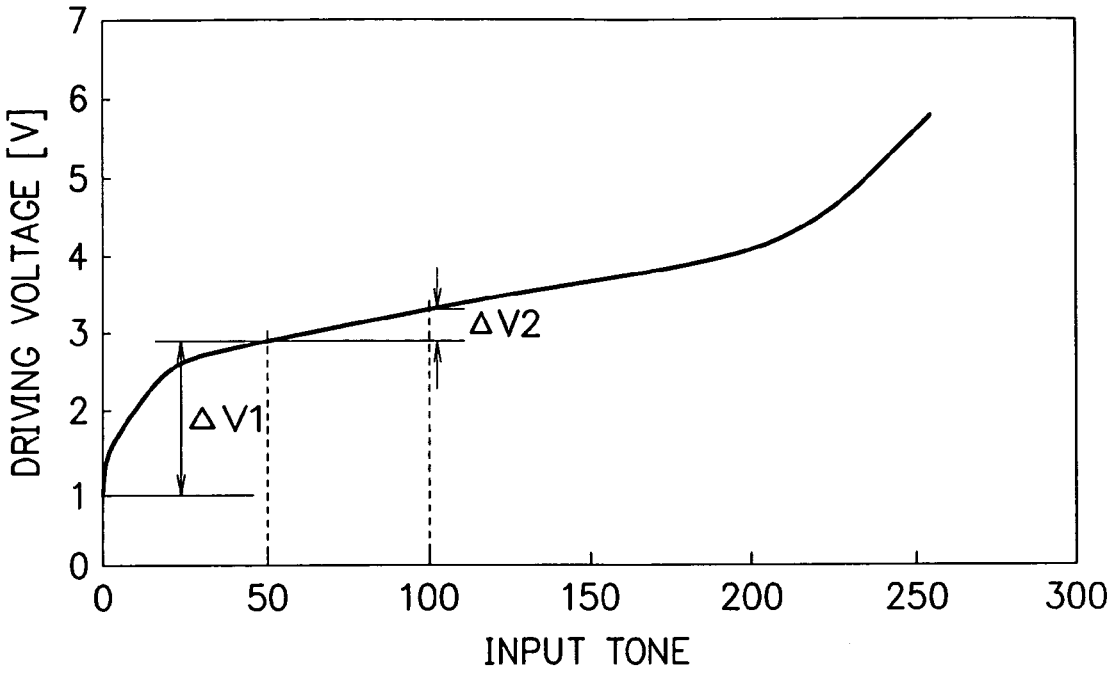
FIG. 7 is a graph showing an example of a relationship between tone value and liquid crystal driving voltage.

FIG. 7 is a graph showing an example of a relationship between the tone value of the inputted image data and the liquid crystal driving voltage, similarly to FIG. 6. The voltage variation of the liquid crystal voltage when the tone value of the inputted image data is changed from 0 (zero) to 50 is ΔV1, while the voltage variation of the liquid crystal driving voltage when the tone value of the inputted image data is changed from 50 to 100 is ΔV2. The tone valiances of the both are identically 50, but ΔV1 is extremely than ΔV2. That is to say, although their tone variances are identical, the variance of their liquid crystal driving voltage varies according to the absolute tone value.

Because the high-speed-response driving is a method to impress the liquid crystal driving voltage suitable for the changed image data, in a region of a large voltage variance, the image data S2 needs to be kept in a fine manner in order to perform a precise high-speed-response driving. That is to say, in the neighborhood of ΔV1, the image data S2 needs to be kept in a fine manner.

One method to enhance the data precision would be to increase the number of bits of the image data S2. However, this method leads to an expanded size of circuits such as of the frame memory 202, comparison circuit 211, correction table 212, and so forth. Further, since the frame memory 202 has a standardized number of bits in general, a frame memory with its number of bits being one rank higher has to be used, leading to a cost increase. In the following, embodiments to solve the above-described problem will be explained.

First Embodiment

Figure 9:
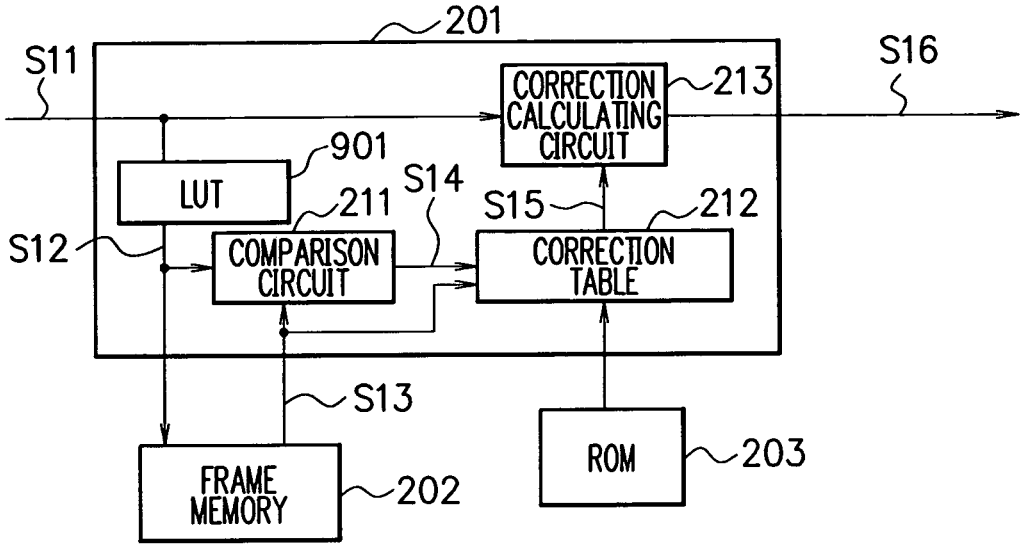
FIG. 9 is a block diagram showing an example of a structure of a high-speed-response circuit according to a first embodiment of the present invention.

FIG. 9 is a block diagram showing an example of a structure of a high-speed-response circuit 111 (FIG. 1), according to a first embodiment of the present invention. FIG. 9 is the structure in FIG. 2 whereto a lookup 901 table is added.

Explained below are points of difference of the high-speed-response circuit in FIG. 9 compared to that of FIG. 2.

The lookup table 901 converts an image data S11 having m bits into an image data S12 having n bits. The image data S11 consists of red, green and blue image data respectively having m bits. Here, n bits are fewer than m bits. The relationship between the image data S11 and the image data S12 are explained below with reference to FIG. 11.

Figure 11:
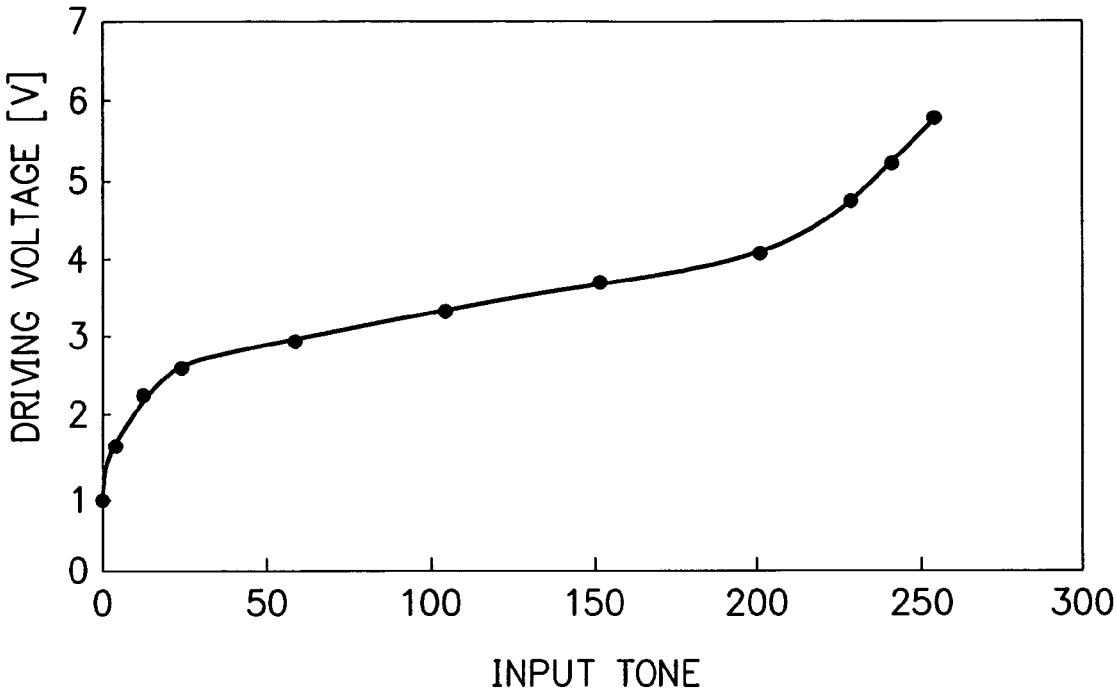
FIG. 11 is a graph showing an example of a relationship between tone value of an inputted data and liquid crystal driving voltage.

FIG. 11 is a graph showing the relationship between the tone value of an inputted image data and the liquid crystal driving voltage. The solid line represents the image data S11 having m bits. The dots on the solid line represent the image data S12 having n bits. The image data S12 is mapped from the image data S11 in irregular intervals.

The lookup table 901 is a conversion table to store the correspondence between the image data S11 and the image data S12, and maps the image data S11 to the image data S12 in irregular intervals. Further, the lookup table 901 maps the image data S11 to the image data S12 such that the levels of the liquid crystal driving voltage corresponding to the image data S2 (vertical axis of FIG. 11) are in regular intervals. With the variance of the liquid crystal driving voltage being constant, if the liquid crystal driving response speed is the same between the two data, this mapping is appropriate. If the liquid crystal driving response speed is not the same, then the lookup table 901 maps the image data S11 to the image data S12 in a manner that the response speeds to the liquid crystal driving voltage for the image data S12 are in regular intervals. Hence, in the relation curve between the image data and the liquid crystal driving voltage, the conversion to the image data S12 can be carried out such that the sharp curve portion is fine, and the moderate curve portion is rough. This means that the resolution can be enhanced in a critical portion, allowing a high-quality image display.

In FIG. 9, the image data S12 is written in the frame memory 202. The frame memory 202 stores the image data S12 in the amount of one frame. For example, the image data S11 consists of red, green, and blue image data respectively having 8 bits. The image data S12 consists of a 5-bit red, 6-bit green, and 5-bit blue image data having 16 bits in total, so that it can be efficiently stored in a memory of a standard size. The number of bits for green is greater than that of red and blue, since green is an important color data having greater influence on the level of brightness. The frame memory 202 delays the image data S12 for one frame, and outputs an image data S13. The comparison circuit 211 compares the image data S12 of the present frame to the image data S13 of the antecedent frame, and outputs a difference data S14 thereof in units of pixel.

The correction table 212 corrects the difference data S14 according to the image data S13, and outputs a difference data S15. The correction table 212 reads therein the correction data from the ROM 203 in advance. The correction table 212 may perform correction according to the image data S11 or S12 instead of the image data S13. The correction calculating circuit 213 is an adding circuit, which adds the image data S11 and the difference data S15, and outputs the image data S16. As a result, the high-speed-response driving shown in FIG. 5 can be realized.

The high-speed-response circuit of FIG. 2 stores the image data S2 in the frame memory 202 in a manner that the intervals on the axis for tone value (the horizontal axis in FIG. 10) of the inputted image data are constant, as shown in FIG. 10. For the portion in which the image data S2 should be kept in a fine manner, the data is in the regular interval. When the number of bits of the image data S2 is increased, the size of the circuit has to be larger, so that a frame memory 202 of one rank higher must be used. In addition, the portions in the image data S2 which do not need to be kept in a fine manner are also fragmented, causing inefficiency.

On the other hand, the high-speed-response circuit of FIG. 9 stores in the frame memory 202 the image data S12 which is shown in intervals on the axis for the liquid crystal driving voltage (the vertical axis in FIG. 11), as shown in FIG. 11. This allows the image data S12 to keep larger amount of data for the portion requiring finer data, and to keep rough data for the portion not requiring fine data. By using the lookup table 901, the image data S12 can be kept optimally in the frame memory 202 without increasing the number of bits thereof.

Since the response of the liquid crystal is evaluated on a basis of brightness, a lookup table 901 having an identical output bits for red, green, and blue may be used. However, considering the size of the frame memory 202, a lookup table 901 having more bits just for green of which the brightness is high can be used, as it leads to a higher precision. For example, the number of bits for the general frame memory 202 is fixed such as into 16 bits or 32 bits. When the 16-bit frame memory 202 is used in which the lookup table 901 has the same number of bits for red, blue, and green, the respective colors have 5 bits, leaving one extra bit. In such a case, by allocating five bits for red and blue respectively and six bits for green, the frame memory 202 can be used without loss, and at the same time a high-speed-response driving with high precision can be realized.

Second Embodiment

A second embodiment of the present invention is hereinafter explained. The reference power supply circuit 113 in FIG. 1 may consist of an amplifier of digital-analog-converter (DAC) type. The DAC-type amplifier 113 can generate plural types of reference power supply voltages (liquid crystal reference driving voltages), and change the reference power supply voltages to be generated according to a control signal. The DAC-type amplifier 113 can change the reference power supply voltage and switch the gamma characteristic depending on the image to be displayed. More details are described below with reference of FIGS. 13A and 13B.

Figure 13A:
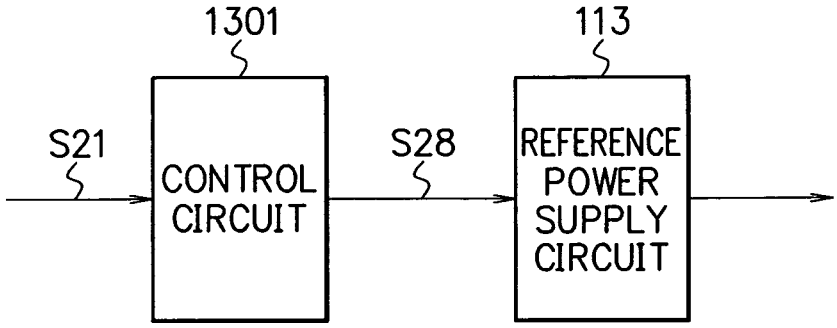
FIG. 13A is a block diagram showing an example of a structure of a reference power supply circuit and a control circuit thereof.
Figure 13B:
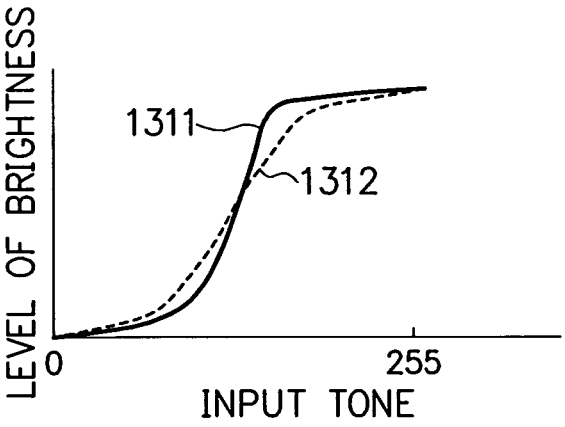
FIG. 13B is a graph showing an example of a gamma characteristic.

The FIG. 13A shows a structural example of the reference power supply circuit (DAC-type amplifier) 113 and a control circuit 1301 thereof, while FIG. 13B shows a gamma characteristic. The gamma characteristic shows the relationship between the tone value and the level of brightness of the inputted image data.

The control circuit 1301 analyzes the tone distribution of one-frame data of the image data S12, and outputs a gamma characteristic signal S28. For example, when medium values makes up majority of the range of tones from 0 (zero) to 255, a gamma characteristic 1312 is selected so that the portion is finely quantized. On the other hand, if small and large values make up the majority of the range of tones from 0 (zero) to 255 (for example, where there are only black and white pixels), a gamma 1311 is selected to enhance the contrast of the image. The reference power supply circuit 113 generates reference power supply voltages for realizing the gamma characteristic 1311 or 1312, depending on a gamma characteristic signal S28 that is selected.

Figure 8:
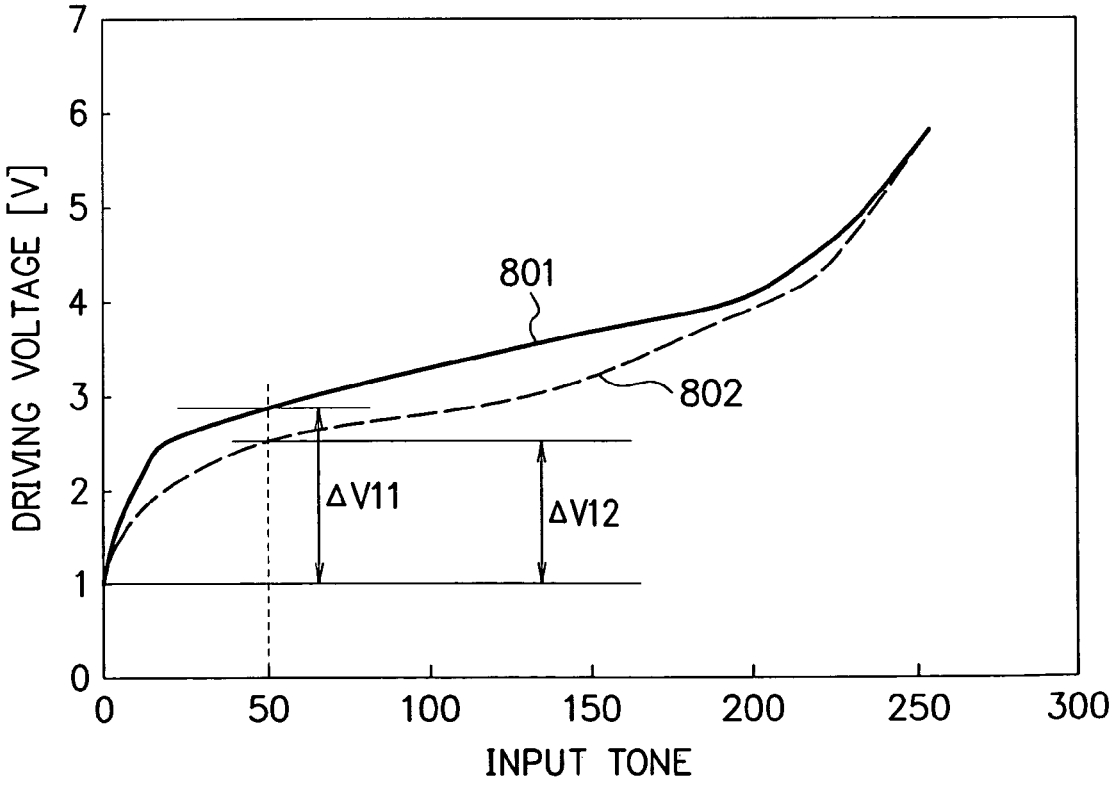
FIG. 8 is a graph showing an example of a relationship between tone value of an inputted image and liquid crystal driving voltage when a gamma characteristic is switched over.

FIG. 8 is a graph showing a relationship between the tone value of an inputted image data and the liquid crystal driving voltage. Two characteristics 801 and 802 correspond to the two types of gamma characteristics (see FIG. 13B). In actual cases, there exists a combination of characteristics based on the precision of the DAC of the reference power supply circuit 113, but herein, for convenience sake, the two types of characteristics 801 and 802 are presented.

In the characteristic 801, the variance of the liquid crystal driving voltage when the tone of the inputted image data changes from 0 (zero) to 50 is ΔV11. In the characteristic 802, similarly, the variance of the liquid crystal driving voltage when the tone of the inputted image data changes from 0 (zero) to 50 is ΔV12. ΔV11 and ΔV12 are clearly different. Here, an issue is the responding characteristic of the liquid crystal. The correction value for ΔV11 and ΔV12 is known not to be in simple proportionality relation. Accordingly, the correction data required for the ROM 203 in FIG. 9 have to be the correction data both for the characteristic 801 and for 802, suggesting that the amount of data doubles. Further, in the actual liquid crystal driving, not only the two types of characteristics, 801 and 802, but also additional characteristics may be necessary, suggesting that the method of storing the correction data of each characteristic in the ROM 203 is extremely inefficient and not practical. Shown in FIG. 12 is a high-speed-response circuit in order to solve this problem.

Figure 12:
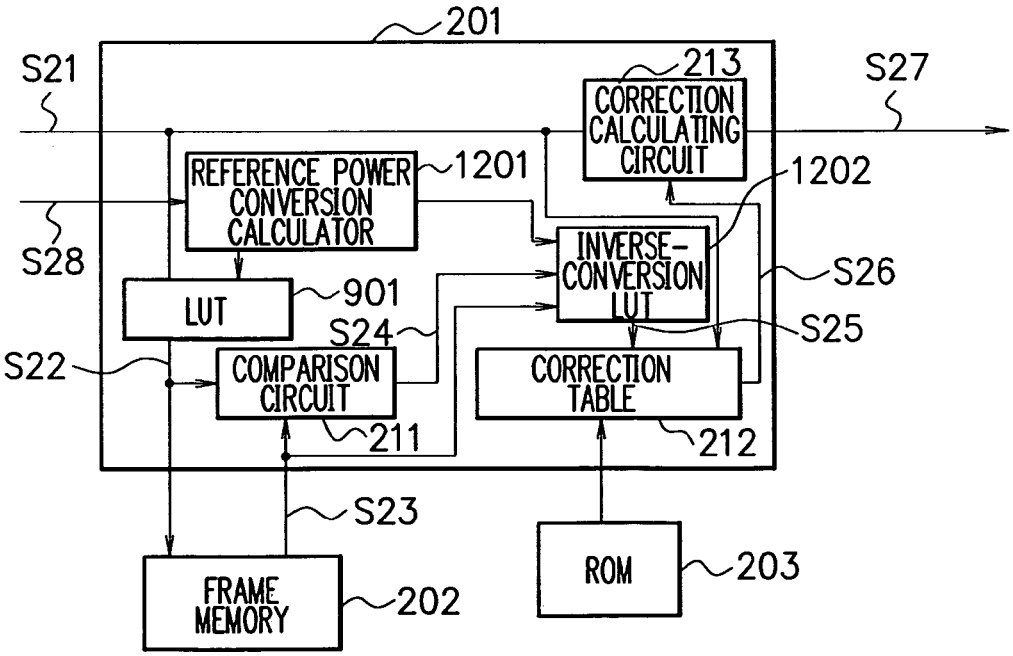
FIG. 12 is a block diagram of showing an example of a structure of a high-speed-response circuit according to a second embodiment of the present invention.

FIG. 12 is a block diagram showing an example of a function of the high-speed-response circuit 111 (FIG. 1) according to the second embodiment of the present invention. It is the circuit of FIG. 9 with a reference power supply conversion calculator 1201 and an inverse-conversion lookup table 1202 added thereto. The difference between the high-speed-response circuits of FIG. 12 and FIG. 9 is explained below.

A reference power supply circuit 113 in FIG. 13A is, for example, a DAC-type amplifier, and changes the reference power supply voltages to be generated according to a control signal S28. Subsequently, in FIG. 12, the reference power supply conversion calculator 1201 calculates and rewrites the content of the lookup table 901. The lookup table 901 converts an image data S21 having m bits into an image data S22 having n bits (n<m).

Figure 14:
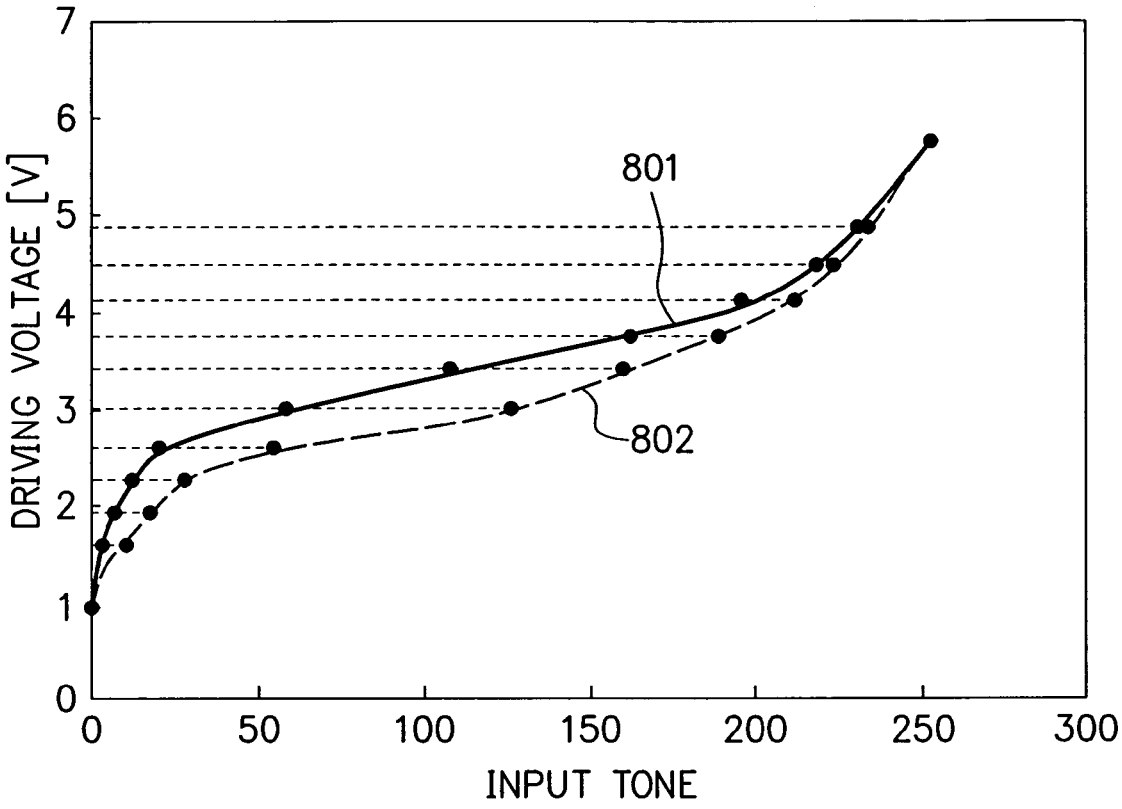
FIG. 14 is a graph showing an example of a relationship between tone value of an inputted image and liquid crystal driving voltage when the gamma characteristic is switched over.

FIG. 14 shows, in comparison to FIG. 8, an example of the data of the two-type characteristics 801 and 802 which are written in the lookup table 901. The solid line and dotted line represent the image data S21 having m bits. The dots along the solid line and the dotted line represent the image data S22 having n bits. Similarly to the first embodiment (FIG. 11), the image data S21 is mapped to the image data S22 such that the liquid crystal driving voltage levels (the vertical axis of FIG. 14) corresponding to the image data S22 are in regular intervals. For example, upon conversion from the characteristic 801 to the characteristic 802, the lookup table 901 is set in a manner that the liquid crystal driving voltage is identical between the characteristic 801 before the conversion and the characteristic 802 after the conversion.

The DAC in the reference power supply circuit 113 and the reference power supply generating part in the data driver 115 are resistance dividing circuits, so that the reference power supply conversion calculator 1201 can change the content of the lookup table 901 with simple calculations.

The image data S22 is written in a frame memory 202. The frame memory 202 stores one-frame amount of the image data S22. The frame memory 202 delays the image data S22 for one frame, and outputs an image data S23. A comparison circuit 211 compares the image data S22 of the present frame and the image data S23 of the antecedent frame, and outputs a difference data S24 thereof.

Here, the values for the difference data S24 differ depending on the characteristics 801 and 802. In order for a correct table 212 common for the characteristics 801 and 802 to be usable, the inverse-conversion lookup table 1202 is provided.

The inverse-conversion lookup table 1202 inversely converts the difference data S24 according to the image data S23, and outputs a difference data S25. The inverse-lookup table 1202 performs the inverse-conversion with respect to the conversion by the lookup table 901. The difference data S24 is inversely converted to the level of the inputted image data S21 regardless its characteristic is 801 or 802. The reference power supply conversion calculator 1201 calculates the contents of the lookup tables 901 and 1202, and rewrites them in the pair form, according to the control signal S28. Note that the inverse-conversion lookup table 1202 may perform the inverse-conversion based on the image data S21 or S22 instead of the image data S23.

The correction table 212 stores one correction data which is common for the characteristics 801 and 802, corrects the difference data S25 based on the image data S21, and outputs a difference data S26. Note that the correction table 212 can perform correction according to the image data S22 or S23 instead of the image data S21. A correction calculating circuit 213 adds the image data S21 and the difference data S26 and outputs the image data S27. Consequently, the high-speed-response driving shown in FIG. 5 can be realized.

According to the second embodiment, the gamma character can be switched frame by frame based on a one-frame amount of image data. By converting the image data by the lookup table 901 and thereafter inversely converting it by the inverse-conversion lookup table 1202, a common correction table 212 can be used. The need to use different correction tables 212 depending on the characteristics 801 and 802 can be eliminated. This effect is significant, in particular where there are a number of switchable characteristics. The ROM 203 no longer needs to store a vast amount of correction data for switching the correction tables 212.

As has been described, with the first and the second embodiments, the amount of frame memory 202 can be reduced by converting the first image data into a second image data having fewer bits. Further, in the relation curve between the image data and the liquid crystal driving voltage in FIG. 11, the image data is mapped so as to be fine in a sharp curve portion, and rough in a moderate curve portion. In other words, the resolution can be enhanced with respect to an important portion of the image, allowing a high-quality image display. Moreover, by correcting the difference data with the correction table 212, the high-speed-response driving comes to be possible as shown in FIG. 5.

The conversion of the first image data into the second image data having a small number of bits allows reduction of the amounts of the frame memory. At the same time, the conversion into the second image memory can be carried out such that, in a relation curve between the image data and the liquid crystal driving voltage, a sharp curve portion is converted to a fine image, while a moderate curve portion is converted to a rough image. Further, the correction of the difference data according to any of the first to the third image data allows a high-speed-response driving of the liquid crystal.

The present embodiment is to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A liquid crystal display, comprising:

a conversion circuit to convert a first image data to a second image data having a fewer number of bits than said first image data;

a frame memory to store the second image data;

a difference circuit to output in units of pixel a difference data between the second image data of a present frame and a third image data of an antecedent frame outputted from said frame memory;

a correction circuit to change said difference data based on one of the first to third image data; and an adding circuit to add the difference data which is changed and the first image data, wherein said conversion circuit maps the first image data nonlinearly to the second image data in irregular intervals.

2. The liquid crystal display according to claim 1, wherein said conversion circuit is a conversion table to store a correspondence for the first image data and the second image data.

3. The liquid crystal display according to claim 1, wherein said conversion circuit maps the first data to the second data in such a manner that levels of a liquid crystal driving voltage corresponding to the second image data are in regular intervals.

4. The liquid crystal display according to claim 1, wherein said conversion circuit maps the first image data to the second image data in such a manner that response speeds to level changes of the liquid crystal driving voltage corresponding to the second image data are in regular intervals.

5. The liquid crystal display according to claim 1, wherein said conversion circuit changes a mapping method from the first image data to the second image data upon a change in a relationship between image data and a liquid crystal driving voltage.

6. The liquid crystal display according to claim 1, wherein said conversion circuit can perform different mappings depending on each frame.

7. The liquid crystal display according to claim 1, further comprising an inverse-conversion circuit to inversely convert the difference data based on one of the first to third image data, and wherein said correction circuit corrects the difference data which is inversely converted.

8. The liquid crystal display according to claim 7, further comprising a control circuit to change a conversion method of said conversion circuit and an inverse- conversion method of said inverse-conversion circuit, according to a control signal.

9. The liquid crystal display according to claim 8, wherein said control circuit changes the conversion method of said conversion circuit and the inverse conversion method of said inverse-conversion circuit in pair upon a change in the relationship between the image data and the liquid crystal driving voltage.

10. The liquid crystal display according to claim 9, wherein said conversion circuit and said inverse-conversion circuit can perform conversion and inverse conversion respectively according to each frame.

11. The liquid crystal display according to claim 10, wherein the conversion method and the inverse-conversion method are determined depending on a tone distribution of one-frame data of the first or the second image data.

12. The liquid crystal display according to claim 11, further comprising a reference voltage generating circuit for generating plural types of liquid crystal reference driving voltages, and wherein said control circuit changes the liquid crystal driving voltages generated according to a control signal.

13. The liquid crystal display according to claim 12, wherein said reference voltage generating circuit is a digital-analog-converter-type amplifier.

14. The liquid crystal display according to claim 13, wherein said conversion circuit maps the first image data to the second image data in irregular intervals.

15. The liquid crystal display according to claim 14, wherein said conversion circuit maps the first image data to the second image data in such a manner that levels of the liquid crystal driving voltage corresponding to the second image data are in regular intervals.

16. The liquid crystal display according to claim 14, wherein said conversion circuit maps the first image data to the second image data in such a manner that response speeds to level changes of the liquid crystal driving voltage corresponding to the second image data are in regular intervals.

17. The liquid crystal display according to claim 1, wherein the first to the third image data include red, green, and blue image data, and wherein the red, green, and blue image data do not share a common number of bits.

18. The liquid crystal display according to claim 17, wherein the green image data has a greater number of bits than the red and blue image data.

* * * * *